United States Patent [19]

Ciccarone

[11] Patent Number: 4,819,428

[45] Date of Patent: Apr. 11, 1989

[54] EXHAUST SYSTEM FOR AN INTERNAL COMBUSTION ENGINE

[75] Inventor: Angelo Ciccarone, Milan, Italy

[73] Assignee: Alfa Romeo Auto S.p.A., Naples, Italy

[21] Appl. No.: 9,248

[22] Filed: Jan. 30, 1987

[30] Foreign Application Priority Data

Feb. 27, 1986 [IT] Italy ..... 21071/86[U]

[51] Int. Cl.[4] ..... F01N 7/10

[52] U.S. Cl. ..... 60/323; 181/228; 181/240; 181/268

[58] Field of Search ..... 60/313, 323; 181/227, 181/228, 240, 268

[56] References Cited

U.S. PATENT DOCUMENTS 3,776,364 12/1973 Van Doeren ..... 181/228

4,408,675 10/1983 Keller ..... 181/240

FOREIGN PATENT DOCUMENTS 2402767 5/1979 France ..... 181/228

*Primary Examiner*—Douglas Hart

*Attorney, Agent, or Firm*—Charles E. Brown; Charles A. Brown

[57] ABSTRACT

The invention relates to an exhaust system for a multi-cylinder internal combustion engine comprising at least a manifold formed by individual exhaust ducts connected to the engine's cylinders, connector pipes, into which groups of individual ducts come together, a common exhaust pipe into which the said connector pipes join each other, the silencer mufflers, wherein the system is characterized in that the said silencer mufflers are positioned in correspondence of at least an end of said common exhaust pipe.

5 Claims, 1 Drawing Sheet

EXHAUST SYSTEM FOR AN INTERNAL COMBUSTION ENGINE

The present invention relates to an exhaust system for a multicylinder, internal-combustion engine, the performances of which are optimized, thanks to a particular positioning of silencer mufflers.

It is known that the internal-combustion engine exhaust systems have, above all, the functions of deadening of the sound produced by the engine's exhaust, contributing to optimizing the engine torque curve through the whole range of use revolution speed, conveying and expelling the exhaust gases from the rear portion of the vehicle.

The gases exiting the cylinders of a multicylinder engine are subject to pressure pulsations having different frequencies, which overlap to one another, and which can be exploited, by suitably tuning the exhaust pipes, to exert an influence on cylinders filling, caring to limit the counterpressures, which would negatively affect the maximum power supplied by the engine.

On the evacuation of gases of exhaust systems, the timings of cylinders exhaust valves and their crossover relatively to intake valves, the positioning of the confluence points—viz., nodes—of the individual ducts into a common exhaust pipe, the dimensions of ducts and pipes, i.e., the cross section areas and the lengthes thereof, have an influence.

The noisiness on exhaust is due to the fact that the flue gases are expelled through the exhaust valves according to an intermittent pattern, and at high speed; thus, silencer mufflers are provided, which have the function of dampening the velocity and pressure peaks, rendering the gas flux as constant as possible, with limited pressure drops.

The silencer mufflers can be of absorption, interference, reflection type or of mixed type; often, in exhaust systems, silencers of different conception are adopted, wherein each of them can be based on one or more methods of sound deadening.

In the design of the exhaust systems, often difficulties are met in optimizing the path shape and the dimensions of exhaust pipes, as well as the position and the volume of silencer mufflers, which are generally installed in series along the same pipes; that, because of the constraints imposed by the shape of the floor and by the presence of car's mechanical members.

The object of the present invention is an exhaust system wherein, by means of a particular positioning of the mufflers, it has been possible to improve both the path shape and the dimensions of the exhaust pipes, with the advantage of increasing the engine-supplied power, while the level of sound deadening being kept unchanged; furthermore, a better exploitation of available room was possible.

The invention relates to an exhaust system comprising at least a manifold formed by the individual exhaust ducts connected to engine's cylinders, connector pipes, into which groups of individual ducts come together, a common exhaust pipe into which the said connector pipes join each other, and silencer mufflers, the system being characterized in that the said silencer mufflers are positioned in correspondence of at least an end of said common exhaust pipe.

According to a preferred solution, the said silencer mufflers are positioned along respective end pipes connected to said common exhaust pipe.

According to a solution, the said end pipes remain then separate downstream the mufflers, whilst, according to another solution, downstream the mufflers the pipes come together into a single pipe.

According to a variant, auxiliary silencer mufflers are positioned along said connector pipes, upstream the common pipe.

By the proposed positioning, the silencer mufflers are grouped at the ends of the exhaust system, and thus leave a greater freedom in selection of pipes path shape and dimensioning; furthermore, the volume they take up is prevailingly concentrated in car's rear portion, wherein generally lesser space constraints exist.

Characteristics and advantages of the present invention are now illustrated by referring to the hereto attached FIGS. 1 to 4, wherein preferred forms of practical embodiment of the same invention are shown to purely exemplifying, not-limitative purposes.

Figure 1:
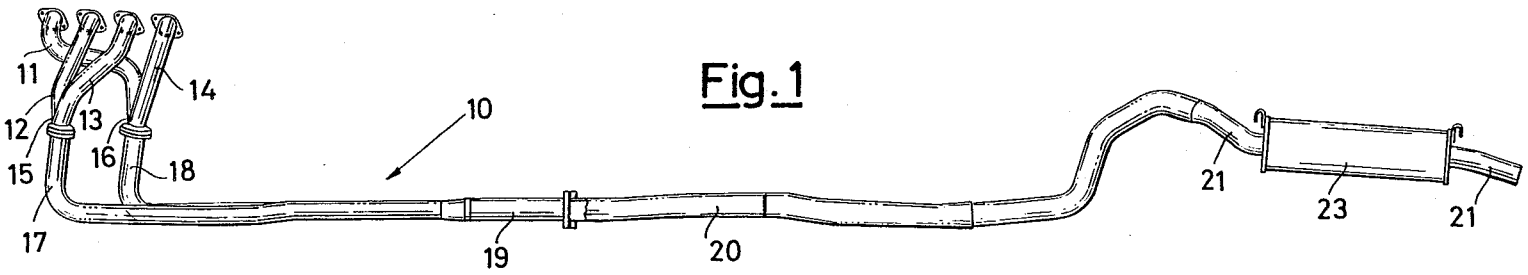
FIG. 1 shows a side view of an exhaust system for an internal combustion engine, accomplished according to the invention.
Figure 2:
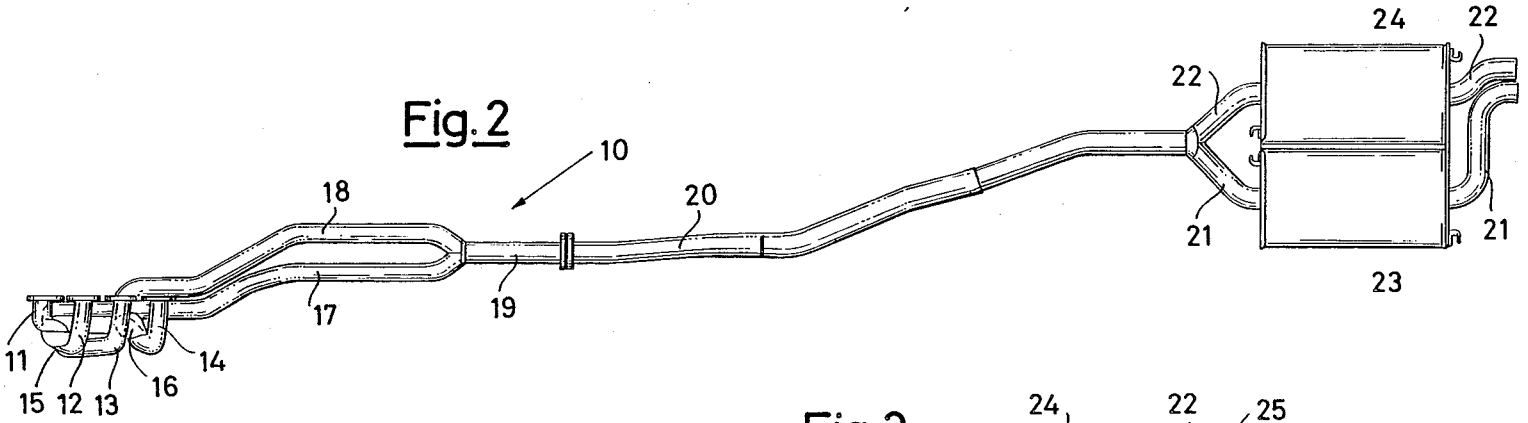
FIG. 2 is a top view of the system of FIG. 1.

In FIGS. 1 and 2, with 10 indicated is in the overall the exhaust manifold of a not shown 4-cylinder internal combustion engine. The manifold comprises individual exhaust ducts 11, 12, 13, 14, which are connected by flanges to engine's cylinder head, and receive the flue gases coming from the respective engine cylinders.

The exhaust ducts join each other, two by two (11 and 14; 12 and 13) into common ducts 15 and 16, to which the connector pipes 17 and 18 are connected by flanges, said connector pipes coming together, in their turn, into a common exhaust pipe, indicated with 19.

To the pipe 19 connected is, by flanges, the common pipe 20, from which the end pipes 21 and 22 branch off in parallel, wherein positioned are respective silencer mufflers 23 and 24, from which the same end pipes come out, leading to the atmosphere.

The mufflers 23 and 24 are not shown in detail, inasmuch as they can be of any known types, suitable to obtain the desired level of sound deadening; they can be, e.g., of mixed type.

By the exhaust system as disclosed, the flue gases coming from the various cylinders are conveyed into the atmosphere through ducts (11 to 14) and pipes (17 to 19), the dimensions of which can be optimized, to the purpose of tuning their natural frequencies with the gas pulsation frequencies, at preselected engine operating regimes, the mufflers 23 and 24 being grouped in the end portion of the same exhaust system.

In this way, the exhaust counterpressures are minimized and the power supplied by the engine is increased, without the sound deadening level of exhaust system being jeopardized.

A further advantage of this solution is the fact that the mufflers 23 and 24 are positioned in the rear portion of the car, wherein generally a greater space availability exists.

Figure 3:
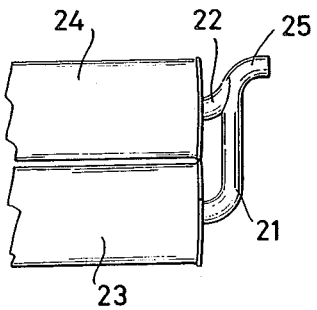
FIGS. 3 and 4 show a scrap view of respective variants of the system of FIG. 1.

In FIG. 3, a variant of a detail of the system of FIG. 1 is shown.

In this case, from the silencer mufflers 23 and 24 the pipes 21 and 22 come out, which join each other into one single end duct 25 before leading to the atmosphere.

The structural and functional characteristics of an exhaust system comprising this modification are analogous to those as of the system of FIGS. 1 and 2.

Figure 4:
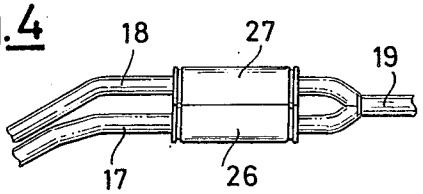

In FIG. 4 a variant of the system of FIG. 1 is shown, wherein, upstream the common pipe 19, in the connector pipes 17 and 18 two auxiliary mufflers 26 and 27 are positioned, e.g., of the reflection type, to be used if the level of sound deadening which can be obtained by means of mufflers 22 and 23 is not the optimum level.

What is claimed:

1. Exhaust system for a multicylinder internal combustion engine comprising at least a manifold formed by the individual exhaust ducts connected to the engine's cylinders, connector pipes, into which groups of individual ducts come together, a common exhaust pipe into which said connector pipes join each other, and silencer mufflers, said silencer mufflers being positions in side-by-side adjacent relationship at an end of said common exhaust pipe, said silencer mufflers also being positioned along side respective end pipes connected to said common exhaust pipe, said end pipes generally extending in the general direction of said common exhaust pipe and said silencer mufflers being parallel to one another.

2. Exhaust system according to claim 1, characterized in that said end pipes branch off in parallel from said common pipe.

3. Exhaust system according to claim 1, characterized in that said end pipes remain separate downstream the mufflers.

4. Exhaust system for a multicylinder internal combustion engine comprising at least a manifold formed by the individual exhaust ducts connected to the engine's cylinders, connector pipes, into which groups of individual ducts come together, a common exhaust pipe into which said connector pipes join each other, and silencer mufflers, said silencer mufflers being positioned in side-by-side adjacent relationship at an end of said common exhaust pipe, said silencer mufflers also being positioned along side respective end pipes connected to said common exhaust pipe, said end pipes generally extending in the general direction of said common exhaust pipe and said silencer mufflers being parallel to one another, said end pipes downstream of said silencer mufflers coming together in one single pipe.

5. Exhaust system according to claims from 1 to 4, characterized in that auxiliary mufflers are positioned along said connector pipes, upstream the common pipe.

* * * * *